US010539354B2

(12) United States Patent
Shi et al.

(10) Patent No.: US 10,539,354 B2
(45) Date of Patent: Jan. 21, 2020

(54) DIRECT COOLING ICE MAKER

(71) Applicant: Electrolux Home Products, Inc., Charlotte, NC (US)

(72) Inventors: Zhuochen Shi, Anderson, SC (US); Thomas McCullough, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/852,022

(22) Filed: Dec. 22, 2017

(65) Prior Publication Data

US 2019/0195543 A1 Jun. 27, 2019

(51) Int. Cl.

| | |
|---|---|
| ***F25C 1/04*** | (2018.01) |
| ***F25D 11/02*** | (2006.01) |
| ***F25C 5/182*** | (2018.01) |

(52) U.S. Cl.

CPC ..... *F25C 1/04* (2013.01); *F25C 5/182* (2013.01); *F25D 11/02* (2013.01)

(58) Field of Classification Search

CPC ..... F25C 1/14; F25C 5/182; F25D 11/02
See application file for complete search history.

(56) References Cited

U.S. PATENT DOCUMENTS

| | | | | |
|---|---|---|---|---|
| 2,403,406 | A | 7/1946 | Smith | |
| 2,846,854 | A | 2/1954 | Galin | |
| 2,743,588 | A | 5/1956 | Dreier | |
| 2,778,198 | A * | 1/1957 | Heath | F25C 1/04 62/137 |
| 3,192,726 | A | 7/1965 | Newton | |
| 8,104,729 | B2 | 1/2012 | Walke et al. | |
| 8,181,471 | B2 | 5/2012 | Heger et al. | |
| 8,601,829 | B2 | 12/2013 | Heger et al. | |
| 8,616,018 | B2 | 12/2013 | Jeong et al. | |
| 8,875,536 | B2 | 11/2014 | Jeong et al. | |

(Continued)

FOREIGN PATENT DOCUMENTS

| | | |
|---|---|---|
| AU | 2013203181 | 5/2014 |
| EP | 2341303 | 7/2011 |

(Continued)

OTHER PUBLICATIONS

Partial International Search Report for PCT/US2018/065636, dated Apr. 1, 2019, 2 pages.

*Primary Examiner* — Kun Kai Ma
(74) *Attorney, Agent, or Firm* — Pearne & Gordon LLP

(57) ABSTRACT

A refrigeration appliance includes a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment, and an ice maker disposed within the fresh food compartment for freezing water into ice pieces. The ice maker includes an ice mold with an upper surface comprising a plurality of cavities formed therein for the ice pieces, a heater disposed on the ice mold and an ice maker refrigerant tube abutting at least one lateral side surface of the ice mold and cooling the ice mold to a temperature below 0° C. via thermal conduction.

4 Claims, 13 Drawing Sheets

(56) References Cited

U.S. PATENT DOCUMENTS 8,950,197 B2 2/2015 Bortoletto et al.
8,973,391 B2 3/2015 Lee
8,973,392 B2 3/2015 Jeong et al.
9,074,804 B2 7/2015 Yoon
9,080,799 B2 7/2015 Hong et al.
9,109,829 B2 8/2015 Lim et al.
9,261,303 B2 2/2016 Jeong et al.
9,383,131 B2 7/2016 Jeong et al.
9,448,003 B2 9/2016 Shin et al.
9,482,458 B2 11/2016 Jeong et al.
9,492,898 B2 11/2016 An et al.
9,506,680 B2 11/2016 Jeong et al.
9,534,821 B2 1/2017 Yoon et al.
9,568,234 B2 2/2017 Jeong et al.
9,604,324 B2 3/2017 An et al.
9,618,258 B2 4/2017 Shin et al.
9,625,200 B2 4/2017 Gu et al.
9,689,600 B2 6/2017 Jeong et al.
9,719,710 B2 8/2017 Yang
9,791,198 B2 10/2017 Jeong et al.
2009/0044559 A1 2/2009 Heger et al.
2009/0113918 A1 5/2009 Heger et al.
2009/0193824 A1 8/2009 Heger et al.
2009/0272141 A1 11/2009 Heger et al.
2009/0277191 A1 11/2009 Heger et al.
2009/0293508 A1* 12/2009 Rafalovich ..... F25C 5/22 62/66
2009/0308095 A1* 12/2009 An ..... F25C 5/08 62/351
2010/0011786 A1 1/2010 Shin et al.
2010/0139295 A1 6/2010 Zuccolo et al.
2010/0326118 A1 12/2010 Jeong et al.
2011/0000248 A1 1/2011 Jeong et al.
2011/0162392 A1* 7/2011 Lim ..... F25D 29/00 62/66
2011/0162404 A1 7/2011 Shin et al.
2011/0162405 A1 7/2011 Jeong et al.
2011/0162406 A1 7/2011 Shin et al.
2011/0185760 A1* 8/2011 Suh ..... F25B 5/00 62/344
2012/0042681 A1 2/2012 McDaniel
2012/0279240 A1 11/2012 Jeong et al.
2012/0318003 A1 12/2012 Kim et al.
2013/0167569 A1 7/2013 Lee
2013/0167574 A1 7/2013 Yoon
2013/0167575 A1 7/2013 Hong et al.
2013/0227983 A1 9/2013 Jeong et al.
2013/0263621 A1 10/2013 An et al.
2013/0264929 A1 10/2013 An et al.
2013/0298405 A1 11/2013 An et al.
2014/0083127 A1 3/2014 Jeong et al.
2015/0013374 A1 1/2015 Jeong et al.
2015/0135760 A1 5/2015 Jeong et al.
2015/0323238 A1 11/2015 Lim
2016/0245574 A1 8/2016 Jeong et al.
2016/0370050 A1 12/2016 Park
2016/0370053 A1 12/2016 Yang
2016/0370054 A1 12/2016 Yang
2016/0370055 A1* 12/2016 Yang ..... B23P 15/26
2016/0370057 A1 12/2016 Yang
2016/0370058 A1 12/2016 Yang
2016/0370067 A1 12/2016 Park
2016/0370096 A1 12/2016 Yang
2017/0292746 A1 10/2017 Yang
2017/0292750 A1 10/2017 Yang
2017/0307273 A1* 10/2017 Lee ..... F25C 1/24
2017/0350630 A1* 12/2017 Hirai ..... F25B 1/005

FOREIGN PATENT DOCUMENTS

JP 2010114115 A * 5/2010
WO 2017120153 7/2017

* cited by examiner

DIRECT COOLING ICE MAKER

CROSS-REFERENCE TO RELATED APPLICATIONS

Not Applicable

FIELD OF THE INVENTION

This application relates generally to an ice maker for a refrigeration appliance, and more particularly, to a refrigeration appliance including a direct cooling ice maker.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water.

There is provided an ice maker including an evaporator coil in direct contact with an ice tray of the ice maker for cooling the ice tray.

BRIEF SUMMARY OF THE INVENTION

In accordance with one aspect, there is provided a refrigeration appliance including a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment; and an ice maker disposed within the fresh food compartment for freezing water into ice pieces. The ice maker includes an ice mold with an upper surface comprising a plurality of cavities formed therein for the ice pieces, a heater disposed on the ice mold and an ice maker refrigerant tube abutting at least one lateral side surface of the ice mold and cooling the ice mold to a temperature below 0° C. via thermal conduction.

The ice maker refrigerant tube of the ice maker may include a first leg and a second leg abutting opposite lateral side surfaces of the ice mold.

The refrigeration appliance may also include a retention clip that is secured to the ice mold and which applies a retaining force against the ice maker refrigerant tube to thereby bias the ice maker refrigerant tube into abutment with the lateral side surface.

The ice maker refrigerant tube of the refrigeration appliance may include a portion that extends away from ice mold and includes a plurality of cooling fins thereon. A fan may be adapted to convey air across the plurality of cooling fins to thereby provide a cooling airflow throughout the ice maker.

The refrigeration appliance may further include a water fill cup formed integrally with the ice mold as a monolithic body. The ice mold and water fill cup may both include a metal material.

The refrigeration appliance may further include an ice box evaporator disposed within the ice maker and configured for supplying cooling air to an ice bin of the ice maker, wherein the ice box evaporator is connected to an outlet of the ice maker refrigerant tube. A centrifugal fan may convey air from the ice bin of the ice maker, over the ice box evaporator and back to the ice bin.

In accordance with another aspect, there is provided a refrigeration appliance including a fresh food compartment for storing food items in a refrigerated environment having a target temperature above 0° C., a freezer compartment for storing food items in a sub-freezing environment having a target temperature below 0° C., a refrigeration system comprising a system evaporator for providing a cooling effect to at least one of the fresh food compartment and the freezer compartment; and an ice maker disposed within the fresh food compartment for freezing water into ice pieces. The ice maker includes an ice mold with an upper surface comprising a plurality of cavities formed therein for the ice pieces, a heater disposed on the ice mold and at least one passage extending through the ice mold adjacent a lateral side surface of the ice mold for conveying a refrigerant there through and cooling the ice mold to a temperature below 0° C. via thermal conduction.

The refrigeration appliance according to this aspect may include a refrigerant tube that is disposed in the at least one passage and has an outer diameter that is substantially equivalent to a diameter of the at least one passage. The ice mold may be over-molded around the refrigerant tube so that the refrigerant tube is thereby encapsulated within the ice mold.

The refrigeration appliance may include a water fill cup formed together with the ice mold as a monolithic body. The ice mold and the water fill cup may both include a metal material.

The refrigeration appliance may include an ice box evaporator disposed within the ice maker and configured for supplying cooling air to an ice bin of the ice maker, wherein the ice box evaporator is connected to an outlet of the at least one passage in the ice mold.

In accordance with yet another aspect, there is provided a refrigeration appliance including a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment, an ice maker disposed within the fresh food compartment for freezing water into ice pieces, and a valve. The ice maker includes an ice mold with an upper surface comprising a plurality of cavities formed therein for the ice pieces. An ice maker refrigerant tube cools the ice mold to a temperature below 0° C. via thermal conduction. The valve includes an inlet, a first outlet connected to an inlet of the ice maker refrigerant tube; and a second outlet connected to a bypass line around the ice maker refrigerant tube. The inlet of the valve is connected to the first outlet of the valve when the valve is in a first position such that a refrigerant flows through the ice maker refrigerant tube and the system evaporator, in that order. The inlet of the valve is connected to the second outlet of the valve when the valve is in the second position such that the refrigerant flows through the bypass line and the system evaporator, in that order.

In the refrigeration appliance, an ice box evaporator disposed in the bypass line wherein when the valve is in the first position the refrigerant flows only through the ice maker refrigerant tube and the system evaporator, in that order and when the valve is in the second position the refrigerant flows only through the ice box evaporator and the system evaporator, in that order.

In the refrigeration appliance, an ice box evaporator connected to an outlet of the ice maker refrigerant tube and the bypass line wherein when the valve is in the first position the refrigerant flows only through the ice maker refrigerant tube, the ice box evaporator and the system evaporator, in that order and when the valve is in the second position the refrigerant flows only through the ice box evaporator and the system evaporator, in that order.

The ice maker refrigerant tube of the refrigeration appliance may abut at least one lateral side surface of the ice mold.

The ice mold of the refrigerant appliance may include at least one passage extending through the ice mold adjacent a lateral side surface of the ice mold for conveying a refrigerant there through.

DESCRIPTION OF EXAMPLE EMBODIMENTS

Figure 1:
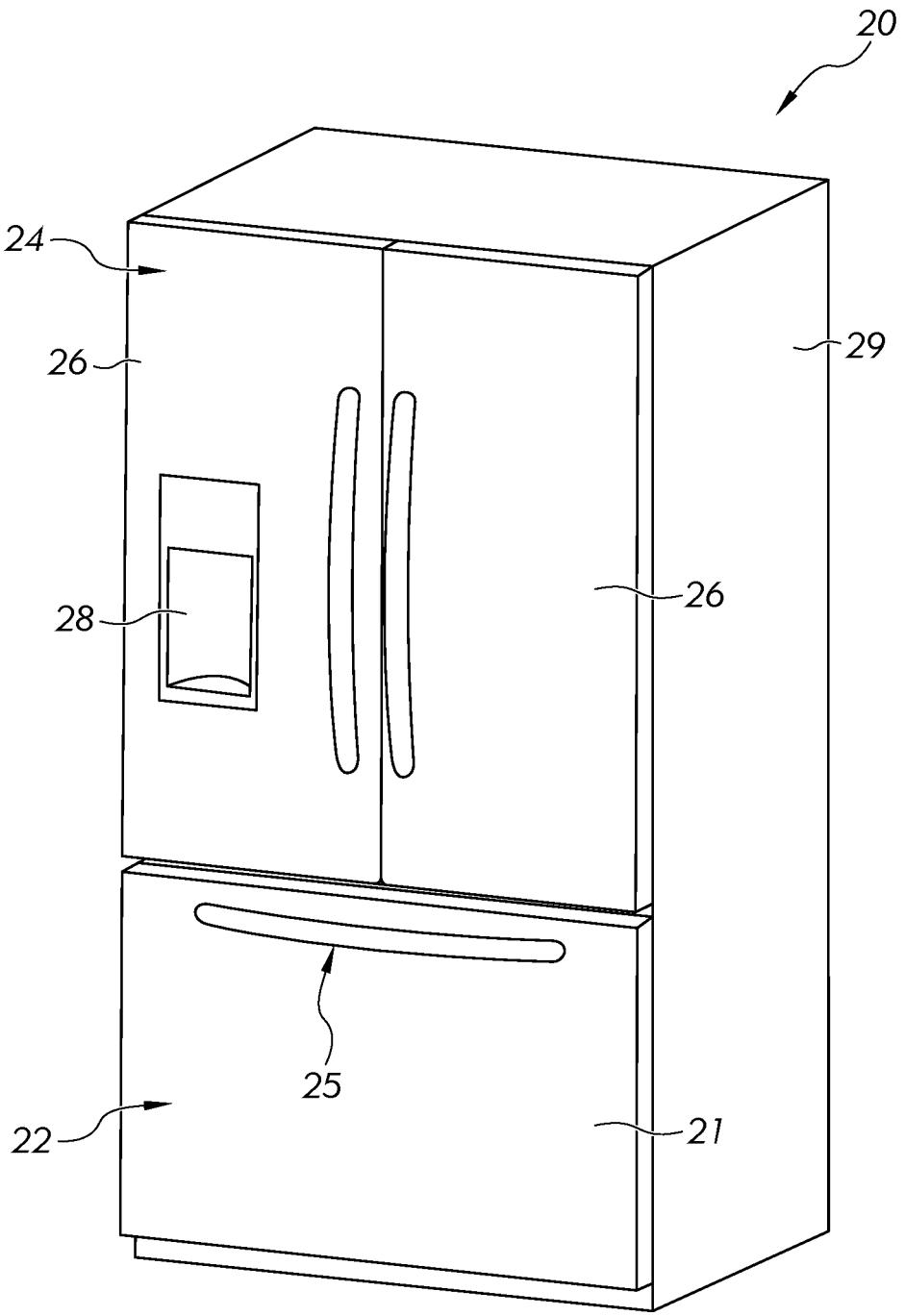
FIG. 1 is a front perspective view of a household French Door Bottom Mount showing doors of the refrigerator in a closed position.
Figure 2:
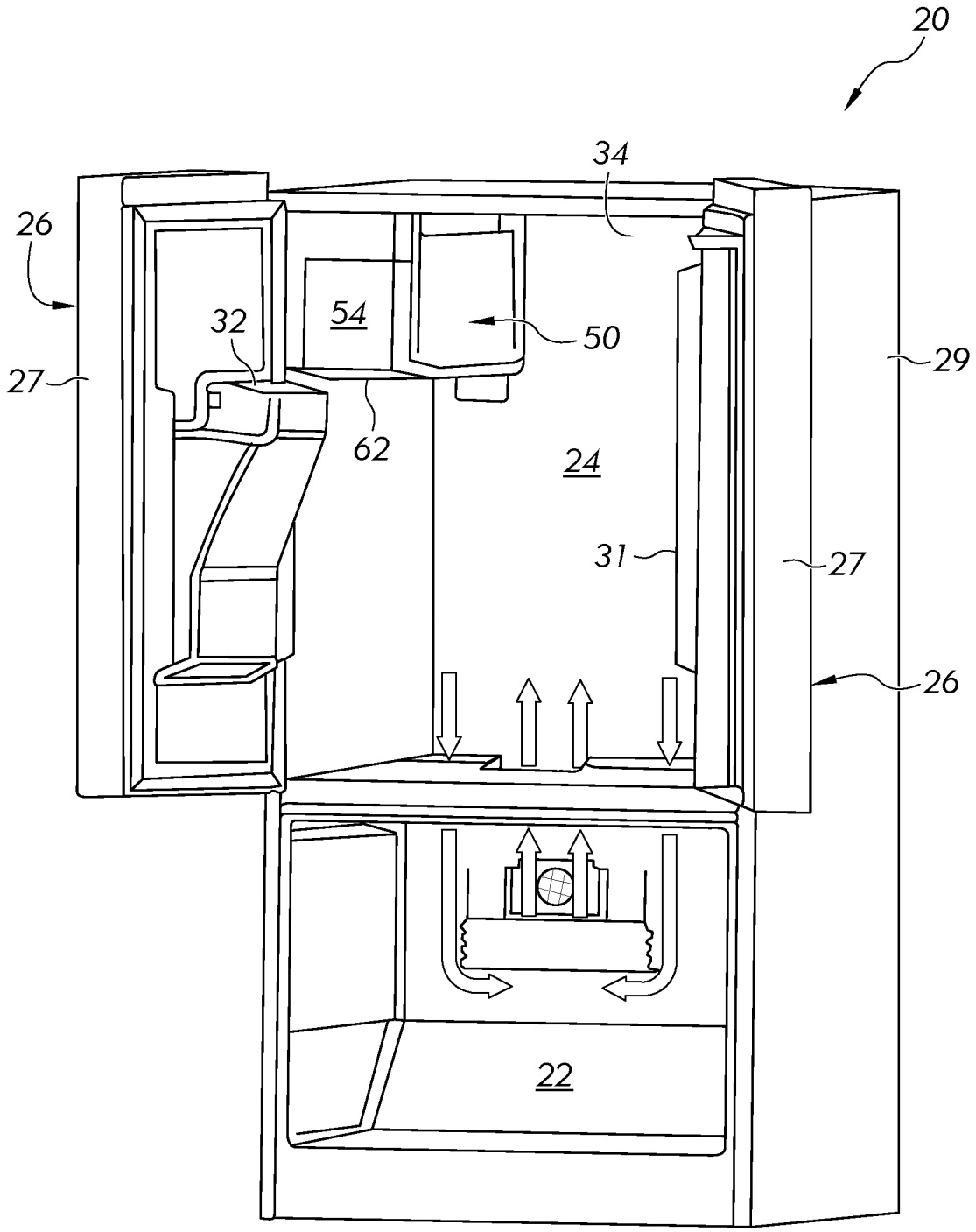
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 20. Although the detailed description that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh food compartment 24 disposed vertically above a freezer compartment 22. However, the refrigerator 20 can have any desired configuration including at least a fresh food compartment 24 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 26 shown in FIG. 1 are pivotally coupled to a cabinet 29 of the refrigerator 20 to restrict and grant access to the fresh food compartment 24. The door 26 can include a single door that spans the entire lateral distance across the entrance to the fresh food compartment 24, or can include a pair of French-type doors 26 as shown in FIG. 1 that collectively span the entire lateral distance of the entrance to the fresh food compartment 24 to enclose the fresh food compartment 24. For the latter configuration, a center flip mullion 31 (FIG. 2) is pivotally coupled to at least one of the doors 26 to establish a surface against which a seal provided to the other one of the doors 26 can seal the entrance to the fresh food compartment 24 at a location between opposing side surfaces 27 (FIG. 2) of the doors 26. The mullion 31 can be pivotally coupled to the door 26 to pivot between a first orientation that is substantially parallel to a planar surface of the door 26 when the door 26 is closed, and a different orientation when the door 26 is opened. The externally-exposed surface of the center mullion 31 is substantially parallel to the door 26 when the center mullion 31 is in the first orientation, and forms an angle other than parallel relative to the door 26 when the center mullion 31 is in the second orientation. The seal and the externally-exposed surface of the mullion 31 cooperate approximately midway between the lateral sides of the fresh food compartment 24.

A dispenser 28 (FIG. 1) for dispensing at least ice pieces, and optionally water, can be provided on an exterior of one of the doors 26 that restricts access to the fresh food compartment 24. The dispenser 28 includes a lever, switch, proximity sensor or other device that a user can interact with to cause frozen ice pieces to be dispensed from an ice bin 54 (FIG. 2) of the ice maker 50 disposed within the fresh food compartment 24. Ice pieces from the ice bin 54 can exit the ice bin 54 through an aperture 62 and be delivered to the dispenser 28 via an ice chute 32 (FIG. 2), which extends at least partially through the door 26 between the dispenser 28 and the ice bin 54.

Referring to FIG. 1, the freezer compartment 22 is arranged vertically beneath the fresh food compartment 24. A drawer assembly (not shown) including one or more freezer baskets (not shown) can be withdrawn from the freezer compartment 22 to grant a user access to food items stored in the freezer compartment 22. The drawer assembly can be coupled to a freezer door 21 that includes a handle 25. When a user grasps the handle 25 and pulls the freezer door 21 open, at least one or more of the freezer baskets is caused to be at least partially withdrawn from the freezer compartment 22.

The freezer compartment 22 is used to freeze and/or maintain articles of food stored in the freezer compartment 22 in a frozen condition. For this purpose, the freezer compartment 22 is in thermal communication with a freezer evaporator 82 (FIG. 11) that removes thermal energy from the freezer compartment 22 to maintain the temperature therein at a temperature of 0° C. or less during operation of the refrigerator 20, preferably between 0° C. and −50° C., more preferably between 0° C. and −30° C. and even more preferably between 0° C. and −20° C.

The refrigerator 20 includes an interior liner 34 (FIG. 2) that defines the fresh food compartment 24. The fresh food compartment 24 is located in the upper portion of the refrigerator 20 in this example and serves to minimize spoiling of articles of food stored therein. The fresh food compartment 24 accomplishes this by maintaining the temperature in the fresh food compartment 24 at a cool temperature that is typically above 0° C., so as not to freeze the articles of food in the fresh food compartment 24. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator 82 can also be blown into the fresh food compartment 24 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 24 independent of the freezer compartment 22. According to an embodiment, the temperature in the fresh food compartment 24 can be maintained at a cool temperature within a close tolerance of a range between 0° C. and 4.5° C., including any subranges and any individual temperatures falling with that range. For example, other embodiments can optionally maintain the cool temperature within the fresh food compartment 24 within a reasonably close tolerance of a temperature between 0.25° C. and 4° C.

Figure 3:
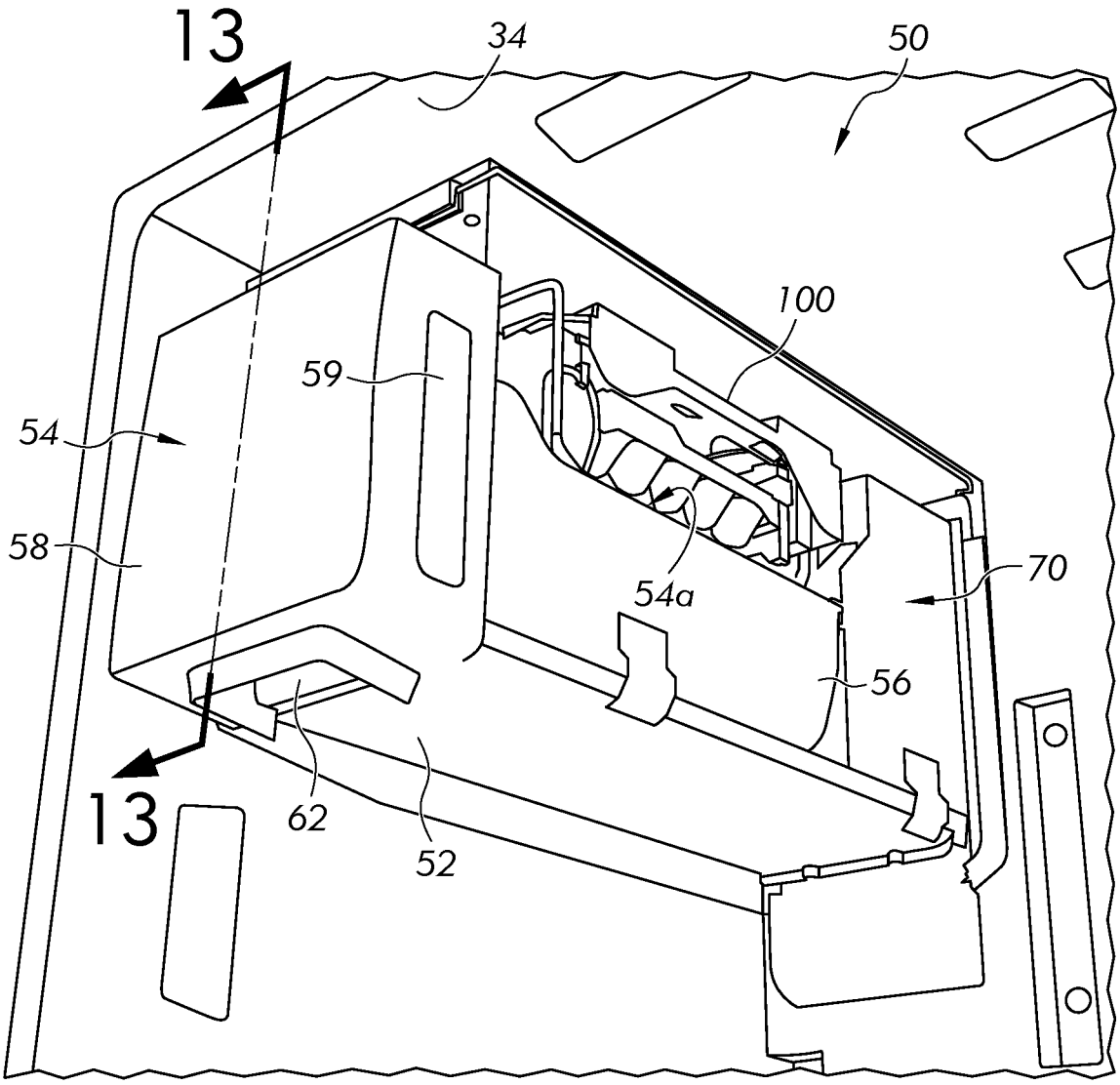
FIG. 3 is a side perspective view of an ice maker with a side wall of a frame of the ice maker removed for clarity.

An illustrative embodiment of the ice maker 50 is shown in FIG. 3. In general, the ice maker 50 includes a frame 52, an ice bin 54, an air handler assembly 70 and an ice tray assembly 100. The ice bin 54 stores ice pieces made by the ice tray assembly 100 and the air handler assembly 70 circulates cooled air to the ice tray assembly 100 and the ice bin 54. The ice maker 50 is secured within the fresh food compartment 24 using any suitable fastener. The frame 52 is generally rectangular-in-shape for receiving the ice bin 54. The frame 52 includes insulated walls for thermally isolating the ice maker 50 from the fresh food compartment 24. A plurality of fasteners (not shown) may be used for securing the frame 52 of the ice maker 50 within the fresh food compartment 24 of the refrigerator 20.

For clarity the ice maker 50 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray assembly 100. The front cover 58 may be secured to the housing 56 by mechanical fasteners that can be removed using a suitable tool, examples of which include screws, nuts and bolts, or any suitable friction fitting possibly including a system of tabs allowing removal of the front cover 58 from the housing 56 by hand and without tools. Alternatively, the front cover 58 is non-removably secured in place on the housing 56 using methods such as, but not limited to, adhesives, welding, non-removable fasteners, etc. In various other examples, a recess 59 is formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) is disposed. The ice crusher is provided for crushing the ice pieces conveyed thereto, when a user requests crushed ice. The augur can optionally be automatically activated and rotated by an auger motor assembly (not shown) of the air handler assembly 70. The aperture 62 is aligned with the ice chute 32 (FIG. 2) when the door 26 is closed. This alignment allows for the auger to push the frozen ice pieces stored in the ice bin 54 into the ice chute 32 to be dispensed by the dispenser 28.

Figure 4A:
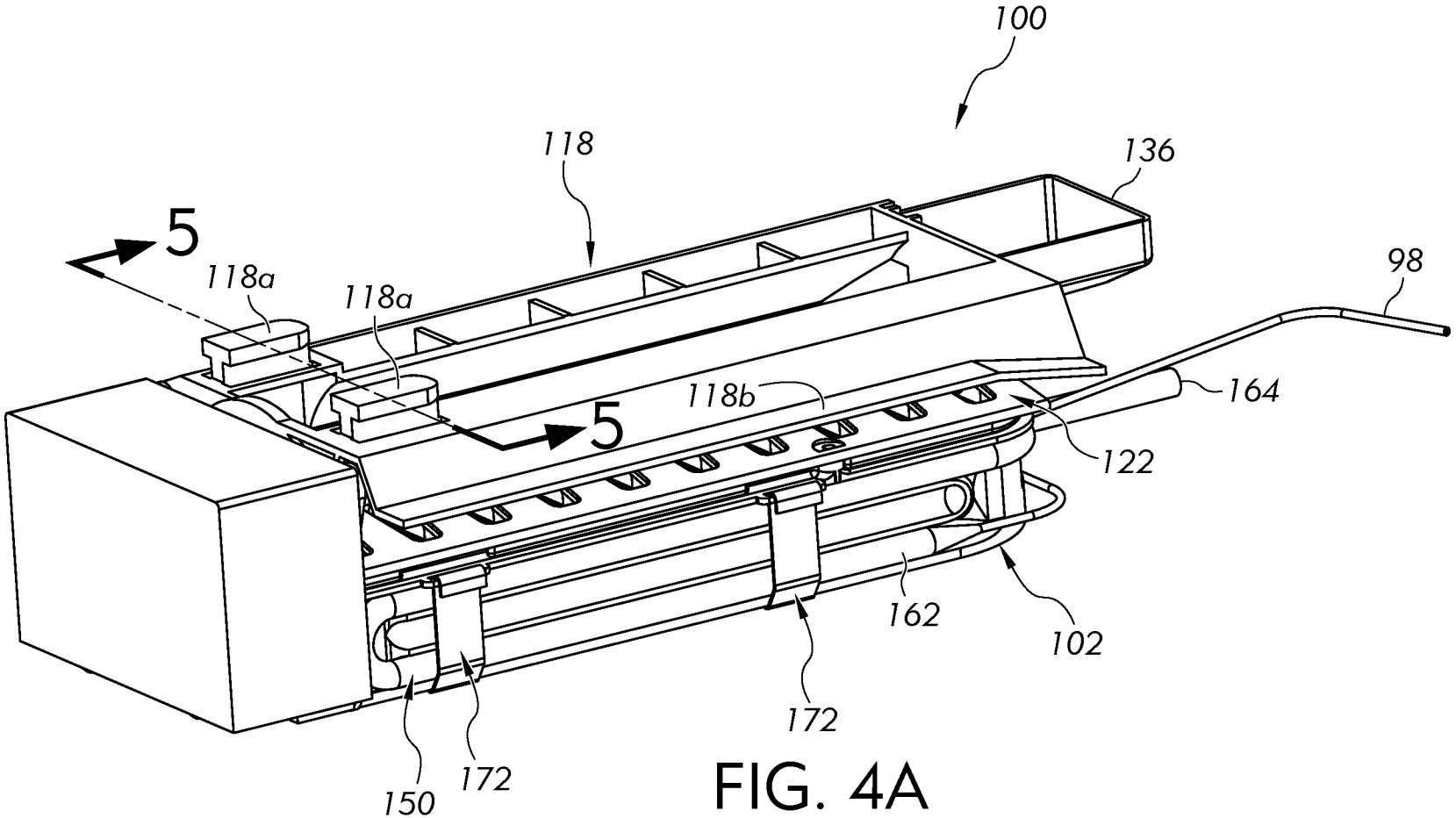
FIG. 4A is a side perspective view of a first embodiment an ice tray assembly for the ice maker of FIG. 3.
Figure 4B:
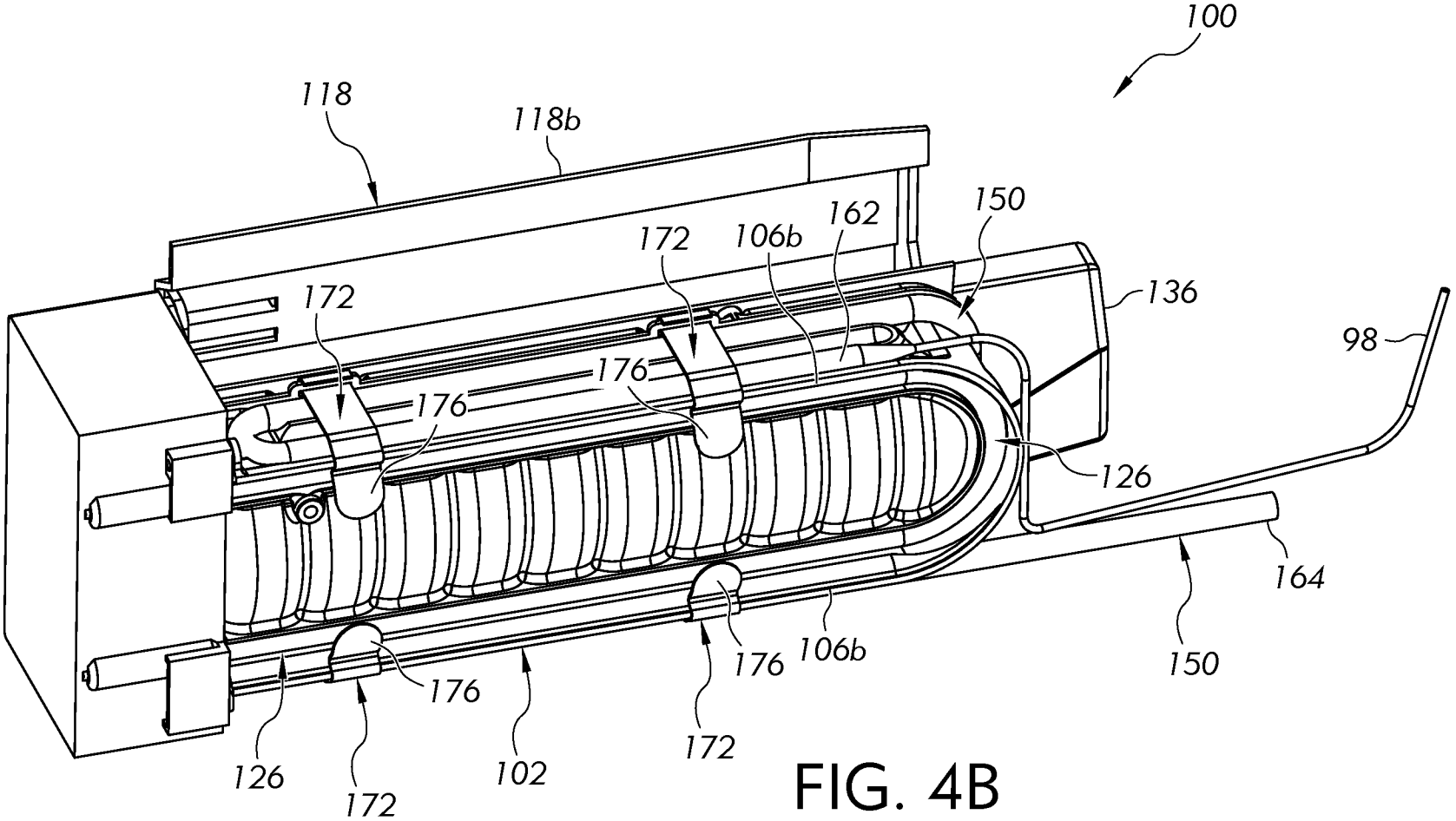
FIG. 4B is a bottom perspective view of the ice tray assembly of FIG. 4A.

Referring to FIGS. 4A and 4B, the ice tray assembly 100 includes an ice mold 102, a cover 118, a harvest heater 126 (FIGS. 4B and 5) for partially melting the ice pieces, a plurality of sweeper-arms 132 (FIG. 5) and an ice maker evaporator 150. The ice mold 102 is preferably made from a thermally conductive metal, like aluminum or steel. It is also preferred that the ice mold 102 is a single monolithic body.

Figure 5:
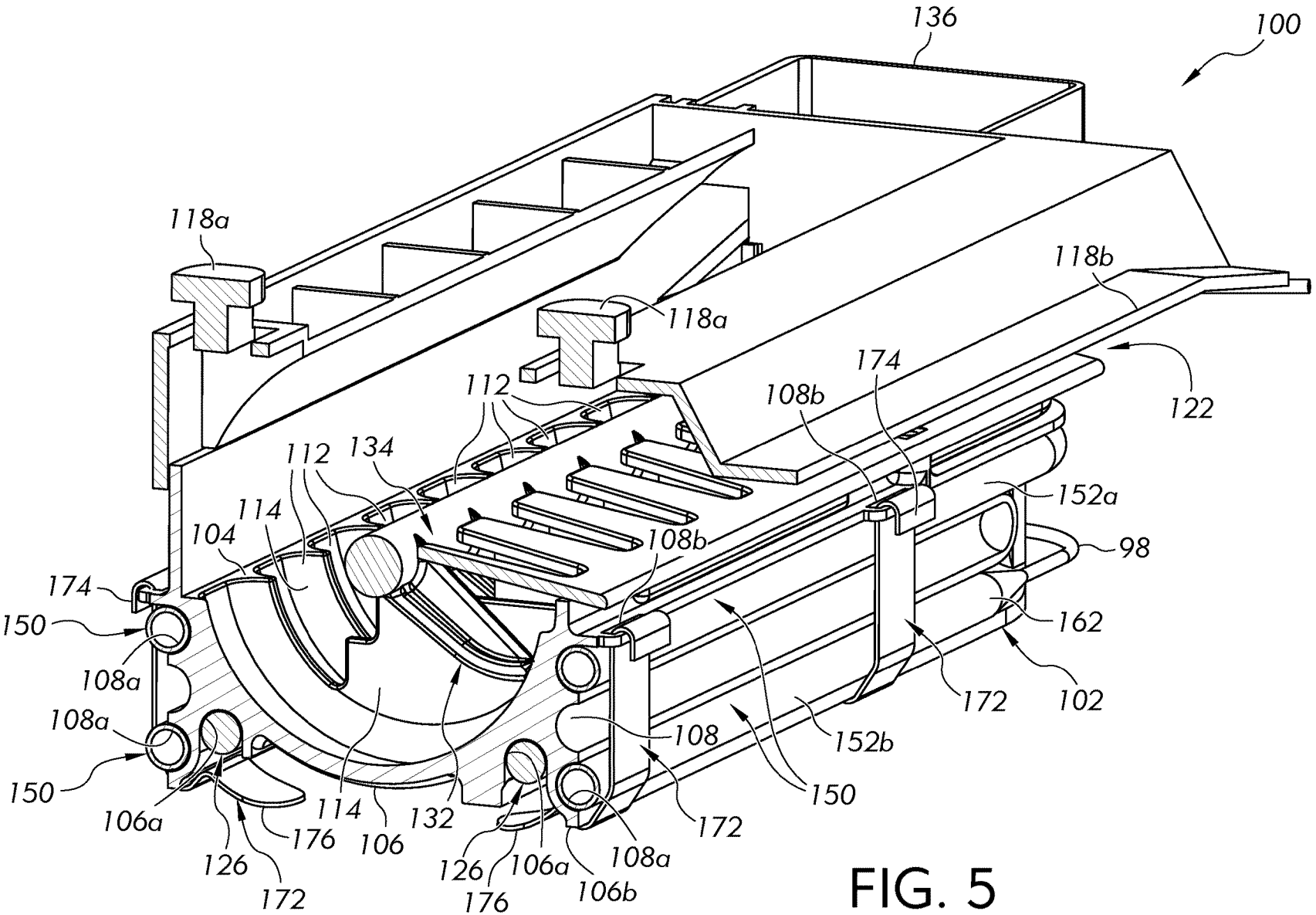
FIG. 5 is a section view of the ice tray assembly of FIG. 4A taken along line 5-5.

Referring to FIG. 5, the ice mold 102 includes a top surface 104, a bottom surface 106 and lateral side surfaces 108. A plurality of cavities 112 is formed in the top surface 104 of the ice mold 102. The plurality of cavities 112 is configured for receiving water to be frozen into ice pieces. The plurality of cavities 112 may be defined by weirs 114, and some or all of the weirs 114 have an aperture therethrough to enable water to flow among the cavities 112. The cavities 112 can have multiple variants. Different cube shapes and sizes are possible (e.g., crescent, cubical, hemispherical, cylindrical, star, moon, company logo, a combination of shapes and sizes simultaneously, etc.) as long as the ice pieces can be removed by the plurality of sweeper-arms 132. In the embodiment shown, the plurality of cavities 112 are aligned in a lateral direction of the ice mold 102.

The bottom surface 106 of the ice mold 102 is contoured to receive the harvest heater 126, as described in detail below. The bottom surface 106 includes a groove 106*a* that extends about a periphery of the bottom surface 106 for receiving the harvest heater 126 therein.

The lateral side surfaces 108 are contoured or sculpted to receive the ice maker evaporator 150. The lateral side surfaces 108 may include elongated recess 108*a* that closely match the outer profile of the ice maker evaporator 150, as described in detail below.

Referring to FIGS. 4A and 5, the cover 118 is attached to the top surface 104 of the ice mold 102 for securing the ice tray assembly 100 to the liner 34 of the fresh food compartment 24. The ice mold 102 may also be attached to an interior of the frame 52 of the ice maker 50 if installed as a unit. The cover 118 includes tabs 118*a* for securing the ice tray assembly 100 to mating openings (not shown) in the liner 34 or in a top wall of the frame 52. One longitudinal edge 118*b* of the cover 118 is dimensioned to be spaced from an upper edge of the ice mold 102 to define an opening 122. The opening 122 is dimensioned to allow ice pieces to be ejected from the ice tray assembly 100, as described in detail below.

Referring to FIGS. 4B and 5, the harvest heater 126 is attached to the bottom surface 106 of the ice mold 102 to provide a heating effect to the ice mold 102 to thereby separate congealed ice pieces from the ice mold 102 during an ice harvesting operation. The heater 126 may be an electric resistive heater, and may be capture in the groove 106*a* formed in the bottom surface 106 of the ice mold 102. The heater 126 is configured to be in direct or substantially direct contact with the ice mold 102 for increased conductive heat transfer. In the embodiment shown, the harvest heater 126 is a U-shape element that extends around a periphery of the bottom surface 106 and has a cylindrical outer surface. It is contemplated that the groove 106*a* may have a cylindrical contour that matches the outer cylindrical outer surface of the harvest heater 126. In the embodiment shown, the legs of the U-shaped heater 126 extend along the lateral direction of the ice mold 102. It is contemplated the heater 126 may have other shapes, for example, but not limited to, circular, oval, spiral, etc. so long as the heater 126 is disposed in direct or substantially direct contact with the ice mold 102.

The plurality of sweeper-arms 132 are disposed in the cavities 112 formed in the top surface 104 of the ice mold 102. The plurality of sweeper-arms 132 are elongated elements that are attached to a rotatable shaft 134. As the shaft 134 rotates the sweeper-arms 132 move through the cavities 112 to force ice pieces in the cavities 112 out of the ice mold 102. In the embodiment shown in FIG. 5, the shaft 134 extends in the lateral direction of the ice mold 102 and is rotatable in a clockwise direction such that the sweeper-arms 132 force the ice pieces into an area above the ice mold 102. A lower surface of the cover 118 is curved to direct the ice pieces toward the opening 122 between the cover 118 and the ice mold 102. As the sweeper-arms 132 continue to rotate, the ice pieces are then ejected from the ice tray assembly 100 into the ice bin 54 (FIG. 3) positioned below the ice tray assembly 100.

Prior to actuating the plurality of sweeper-arms 132, the harvest heater 126 is energized to heat the ice mold 102 which, in turn, melts a lower surface of the ice pieces in the plurality of cavities 112. A thin layer of liquid is formed on the lower surface of the ice pieces to aid in detaching the ice pieces from the ice mold 102. The plurality of sweeper-arms 132 may then eject the ice pieces out of the ice mold 102.

In the embodiment shown, the ice mold 102 is a monolithic body that includes an integrally formed water fill cup 136. It is contemplated that the water fill cup 136 may be made of the same material as the ice mold 102. In particular, it is contemplated that the ice mold 102 may be made of a metal material, e.g., aluminum or steel. The fill cup 136 includes side and bottom walls that are planar and sloped toward the cavities 112 in the ice mold 102. As such, water injected into the fill cup 136 will flow, by gravity to the cavities 112 in the ice mold 102. It is contemplated that the thermal energy provided by the harvest heater 126 may also be sufficient to melt frost or ice that may accumulate on the fill cup 136 during normal operation.

Figure 6:
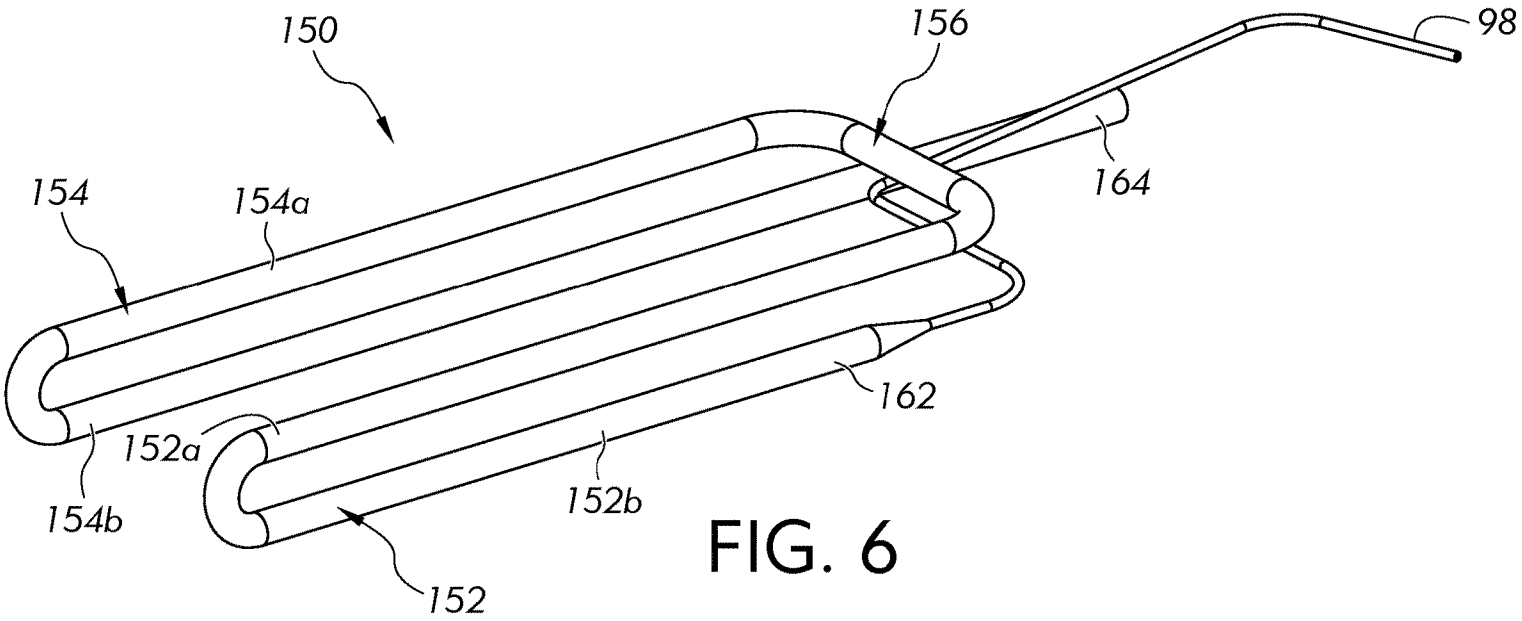
FIG. 6 is a side perspective view of an ice maker evaporator for the ice tray assembly of FIG. 4.

Referring to FIG. 6, the ice maker evaporator 150 includes a first leg 152, a second leg 154 and a connecting portion 156. In the embodiment shown, the first leg 152 is U-shaped and includes an upper portion 152*a* and a lower portion 152*b*. Similarly, the second leg 154 is U-shaped and includes an upper portion 154*a* and a lower portion 154*b*. The upper portions 152*a*, 154*a* and the lower portions 152*b*, 154*b* are illustrated in FIG. 6 as straight elongated elements that extend along the lateral direction of the ice mold 102. It is contemplated that these portions 152*a*, 154*a*, 152*b*, 154*b* can have other shapes, e.g., curved, wavy, tooth-shaped, stepped, etc. so long as these portions 152*a*, 154*a*, 152*b*, 154*b* are in intimate or surface-to-surface contact with the respective lateral side surfaces 108 of the ice mold 102. In the embodiment shown, the ice maker evaporator 150 has a U-shape. It is contemplated that the ice maker evaporator 150 may have other shapes so long as the ice maker evaporator 150 is in intimate contact with the ice mold 102.

The ice maker evaporator 150 includes an inlet end 162 for allowing a refrigerant to be injected into the ice maker evaporator 150 and an outlet end 164 for allowing the refrigerant to exit the ice maker evaporator 150. A first capillary tube 98 (described in detail below) is attached to the inlet end 162.

Referring to FIG. 5, in the embodiment shown, the ice maker evaporator 150 has a cylindrical outer surface and the respective recesses 108*a* formed in the lateral side surfaces 108 of the ice mold 102 have a matching contour. In the embodiment shown, the recesses 108*a* are contoured to preferably contact at least half or 180° of the cylindrical outer surface of the first and second legs 152, 154 of the ice maker evaporator 150. It is contemplated that the amount of contact may be more or less than half or 180°.

Retention clips 172 are provided for applying a retaining force to the ice maker evaporator 150 for securing the ice maker evaporator 150 into both lateral side surfaces 108 of the ice mold 102. In the embodiment shown, the clips 172 include an upper end 174 that is shaped for engaging a slotted opening 108*b* in the lateral side surface 108 of the ice mold 102. A lower end 176 of the clip 172 is shaped for allowing the clip 172 to attach to the bottom surface 106 of the ice mold 102. In the embodiment shown, the upper end 174 is J-shaped for securing the clip 172 to the slotted opening 108*b* and the lower end 176 is S-shaped to attach the clip 172 to an elongated rib 106*b* extending along opposite edges of the bottom surface 106 of the ice mold 102. The clip 172 is installed by inserting the upper end 174 into the slotted opening 108*b* and then rotating the clip 172 toward the ice mold 102 until the lower end 176 snaps or clips onto the elongated rib 106*b*, or an equivalent feature of the ice mold 102. The clips 172 are dimensioned and positioned to bias or maintain the ice maker evaporator 150 in intimate contact or abutment with the lateral side surfaces 108 of the ice mold 102. It is contemplated that the ice maker evaporator 150 may be configured to snap into the respective recesses 108*a* on the lateral side surfaces 108 of the ice mold 102.

Figure 7:
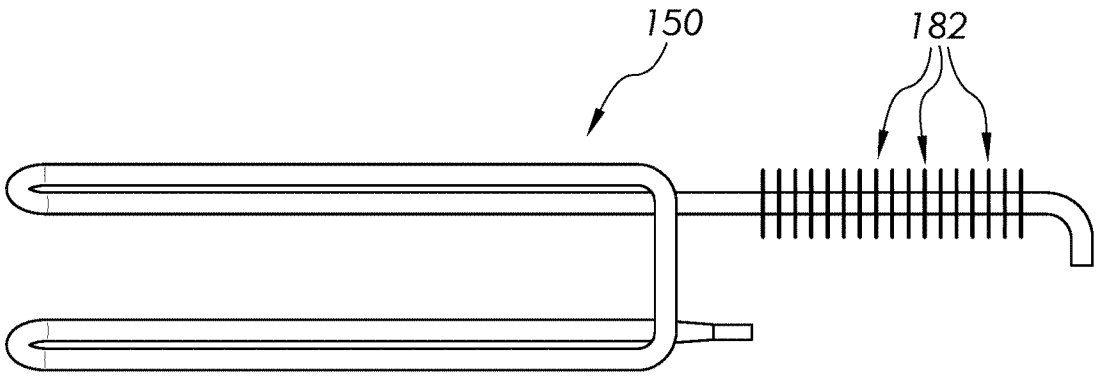
FIG. 7 is a top view of a second embodiment of an ice maker evaporator for the ice tray assembly of FIG. 4.
Figure 8:
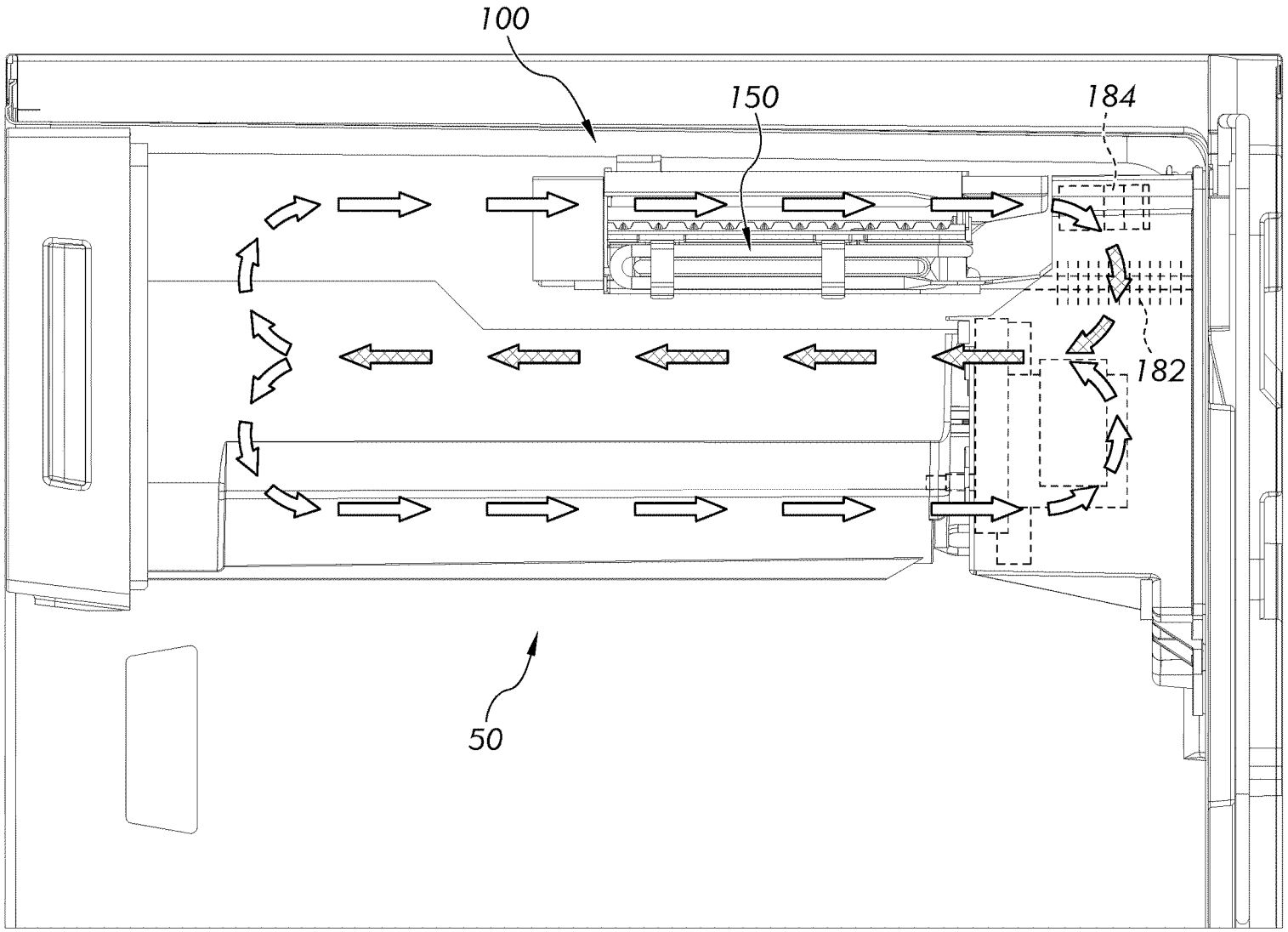
FIG. 8 is a side plane view of the ice maker of FIG. 3 with the ice maker evaporator of FIG. 7 wherein arrows illustrate an example air circulation path within the ice maker.

Referring to FIG. 7, according to another embodiment, the ice maker evaporator 150 may include a plurality of cooling fins 182. Referring to FIG. 8, when the ice maker evaporator 150 is disposed in the ice maker 50 the plurality of fins 182 may be positioned in the air handler assembly 70 proximate a circulation fan 184. When the fan 184 is energized, air is conveyed over the plurality of fins 182 and cooled air is circulated into the ice maker 50. Preferably, the cooled air is conveyed to the ice bin 54 to keep the ice pieces therein cold. Arrows in FIG. 8 illustrate the path of the air circulated within the ice maker 50 from the circulation fan conveying air over the ice maker evaporator 150.

Figure 9:
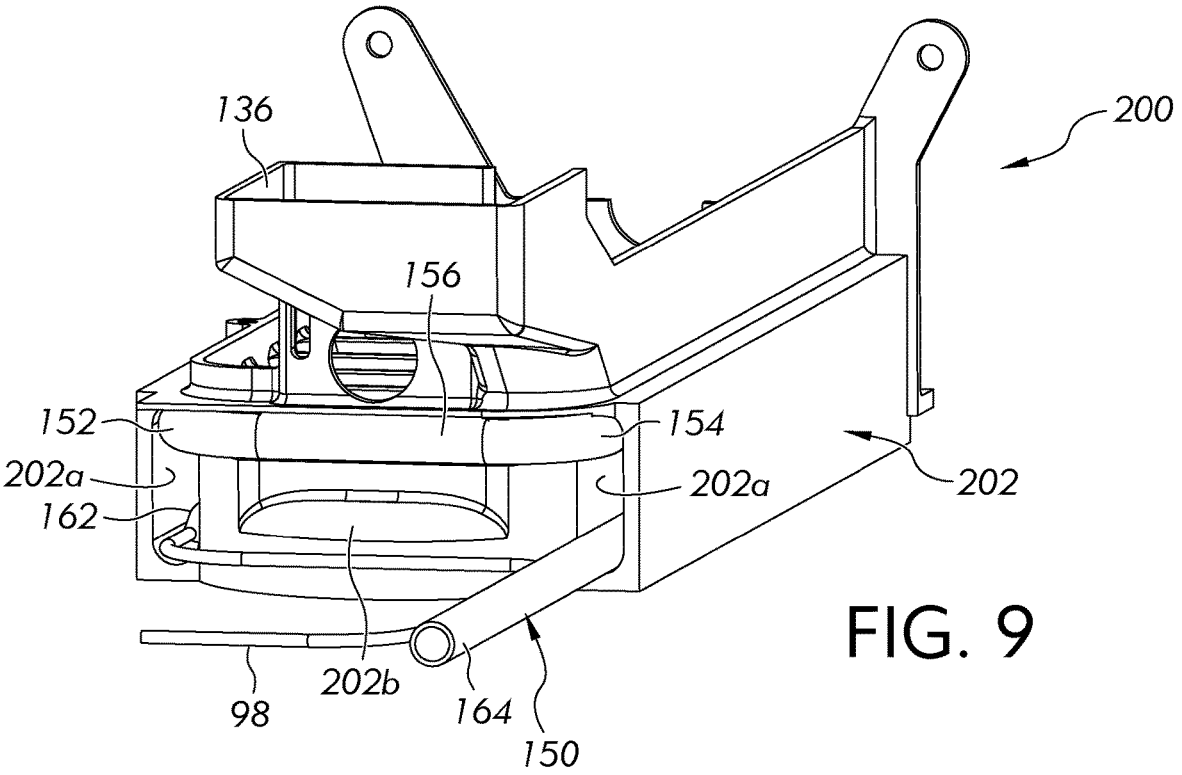
FIG. 9 is a rear perspective view of a second embodiment of an ice tray assembly.

Referring to FIG. 9, a second embodiment ice tray assembly 200 similar to ice tray assembly 100 is shown. The second ice tray assembly 200 includes an ice mold 202. The second ice tray assembly 200 includes other components that are similar or identical to the ice tray assembly 100, but these components are not shown or described in detail below. For example, similar to the ice mold 102, the ice mold 202 includes a plurality of cavities (not shown) that are configured for receiving water to be frozen into ice pieces.

The ice mold 202 includes elongated internal cavities 202*a* that extend along at least one, and preferably opposite sides of the ice mold 202 in the lateral direction of the ice mold 202. The elongated cavities 202*a* are dimensioned and positioned to receive the first leg 152 and preferably also the second leg 154 of the ice maker evaporator 150. The ice mold 202 includes a rear surface 202*b* that is contoured to receive the connecting portion 156 of the ice maker evaporator 150 when the ice maker evaporator 150 is fully inserted into the cavities 202*a*. A clip or fastener (not shown) may be used for securing the ice maker evaporator 150 to the ice mold 202. In the first embodiment ice tray assembly 100 described above, the first leg 152 and the second leg 154 of the ice maker evaporator 150 are positioned on external surfaces of the ice mold 102. In the second embodiment ice tray assembly 200, the first leg 152 and the second leg 154 of the ice maker evaporator 150 are positioned inside the ice mold 202.

Figure 10:
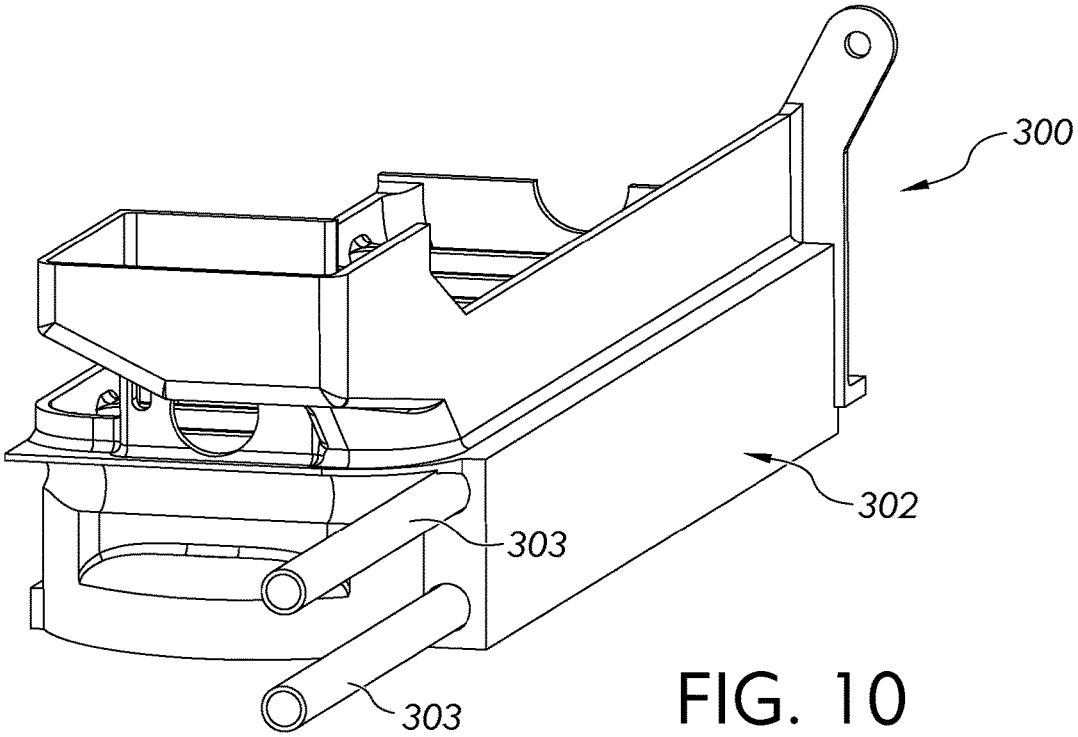
FIG. 10 is a rear perspective view of a third embodiment of an ice tray assembly.

Referring to FIG. 10, a third embodiment ice tray assembly 300 similar to the ice tray assembly 100 is shown. The third ice tray assembly 300 includes an ice mold 302. The third ice tray assembly 300 includes other components that are identical to the ice tray assembly 100, but these components are not shown or described in detail below. For example, similar to the ice mold 102, the ice mold 302 includes a plurality of cavities (not shown) that are configured for receiving water to be frozen into ice pieces. Similar to the second embodiment ice tray assembly 200, the third embodiment ice tray assembly 300 includes tubes 303 that are positioned inside the ice mold 302.

The ice mold 302 is a cast or molded block of metal, e.g., aluminum or steel that is cast around tubes 303 in a manner similar to an over-molding technique typically used in polymer manufacturing. The tubes 303 may be made from stainless steel or another high temperature material that withstands the heat required for casting the metal ice mold 302. Connectors (not shown) may be attached to the tubes 303 for fluidly connecting the tubes 303 to the cooling system of the refrigerator 20. In the embodiment shown, the tubes 303 are disposed along one side of the ice mold 302. The tubes 303 are connected by an internal U-channel (not shown). It is contemplated that the tubes 303 may also be disposed on the opposite lateral sides of the ice mold 302. The tubes 303, when connected to each other and the cooling system define a third ice maker evaporator 350. It is contemplated that the tubes 303 may be inserted into one or more holes (not shown) wherein an outer diameter of the tubes 303 is substantially equivalent to a diameter of the holes such that the tubes 303 are in intimate contact with the ice mold 302. It is also contemplated that the tubes 303 may be include threads for threading the tubes 303 into the ice mold 302. In the embodiment shown, the tubes 303 are parallel to a lower surface of the mold. It is contemplated that the tubes 303 may be sloped or angled relative to the lower surface of the mold.

It is also contemplated that instead of placing the tubes 303 in the ice mold 302 a plurality of passages (not shown) may be formed in the ice mold 302 itself and may extend through the ice mold 302 to define a flow path for the refrigerant. Appropriate connectors would be attached to the ice mold 302 itself for fluidly connecting the passages in the ice mold 302 to the appropriate portions of the cooling system of the refrigerator. As such, the ice mold 302 itself defines the ice maker evaporator 350.

The ice tray assemblies 100, 200, 300 of the instant application employ a direct cooling approach, in which the ice maker evaporators 150, 350 are in direct (or substantially direct) contact with the ice mold 102, 202, 302. The ice pieces are made without cold air ducted from a remote location (e.g., a freezer) to create or maintain the ice. It is understood that direct contact is intended to mean that the ice maker evaporator 150, 350 abuts the ice mold 102, 202, 302. Additionally, although no air is typically ducted from a remote location (e.g., a freezer) to create or maintain the ice, it is contemplated that cold air could be ducted from another location, such as about the system evaporator (not shown), if desired to increase a rate of ice making production or to maintain the stored ice pieces in the ice bin 54 at a frozen state. This could be useful, for example, in a configuration where the ice bin 54 is separated or provided at a distance apart from the ice maker evaporator 150, 350, or where accelerated ice formation is desired.

Still, although the term "evaporator" is used for simplicity, in yet another embodiment the ice maker evaporator 150, 350 could instead be a thermoelectric element (or other cooling element) that is operable to cool the ice mold 102, 202, 302 to a sufficient amount to congeal the water into ice pieces. Similar operative service lines (such as electrical lines) can be provided similar to the inlet/outlet lines described above.

Figure 11:
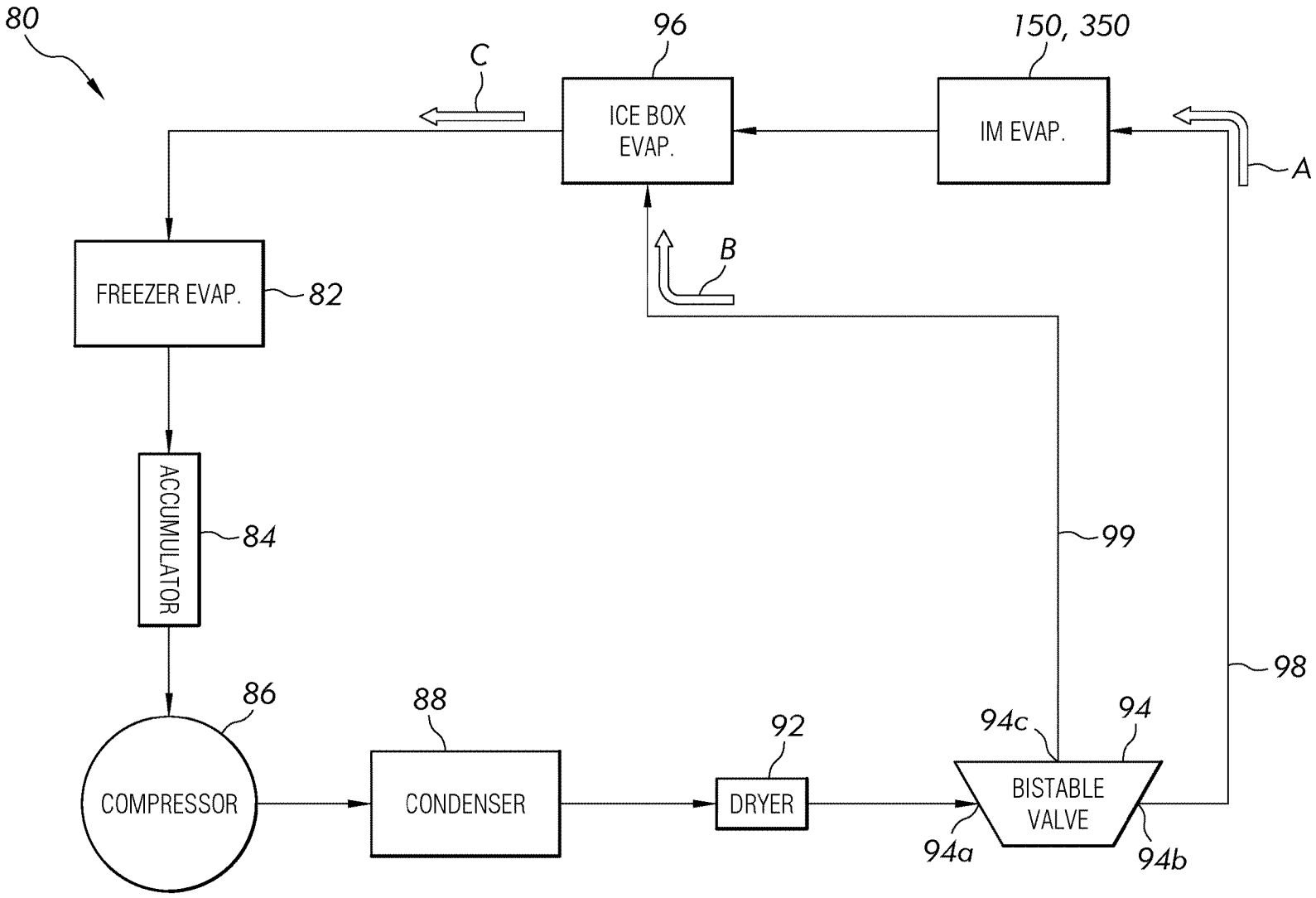
FIG. 11 is a schematic of a cooling system for the refrigerator of FIG. 1.

Referring to FIG. 11, a schematic of a cooling system 80 for the refrigerator 20 is shown. The cooling system 80 includes conventional components, such as a freezer evaporator 82, an accumulator 84 (optional), a compressor 86, a condenser 88 and a dryer 92. These components are conventional components that are well known to those skilled in the art and will not be described in detail herein.

The ice maker evaporator 150, 350 is connected between a valve 94 and an ice box evaporator 96. It is contemplated that both the valve 94 and the dryer 92 may be positioned in a machine room (not shown) of the refrigerator 20. The valve 94 includes a single inlet 94*a* and two outlets 94*b*, 94*c*. The inlet 94*a* is connected to the condenser 88 and optionally to the dryer 92. A first outlet 94*b* is connected to the ice maker evaporator 150, 350 (represented by arrow "A"). The first capillary tube 98 connects the first outlet 94*b* of the valve 94 to the ice maker evaporator 150, 350. A second outlet 94*c* is connected to the ice box evaporator 96 (represented by arrow "B"). A second capillary tube 99 connects the second outlet 94*c* of the valve 94 to the ice box evaporator 96. It is contemplated that the ice box evaporator 96 is an optional component. For example, the ice maker evaporator 96 may not be required if the ice maker evaporator 150 includes the cooling fins 182 that are sufficiently configured to maintain the ice pieces in the ice bin 54 at the desired temperature.

Figure 12:
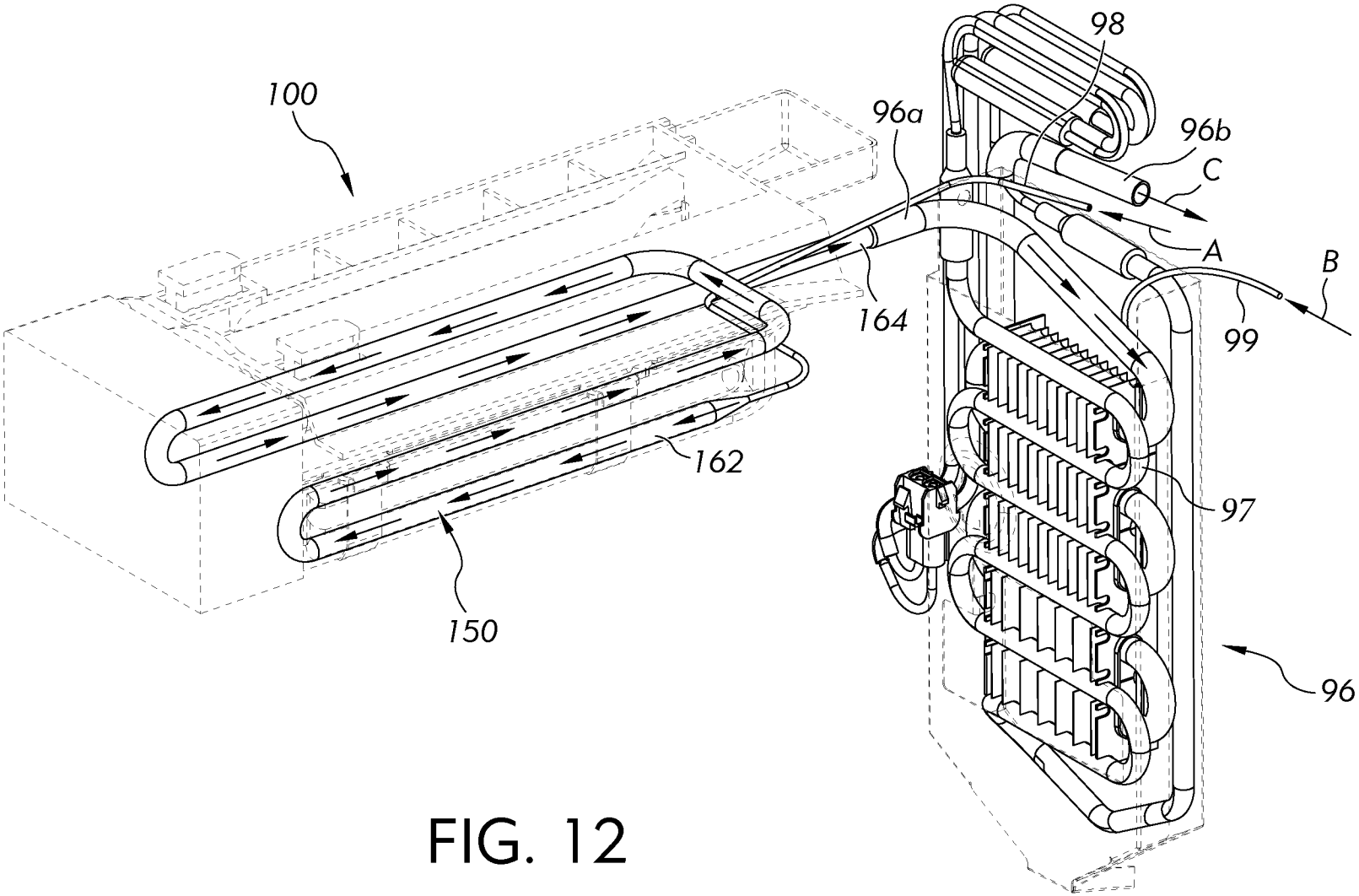
FIG. 12 is a side perspective view of the ice maker evaporator of FIG. 6 and an ice box evaporator illustrating an example flow path of a refrigerant through the ice maker evaporator and the ice box evaporator.

FIG. 12 shows one embodiment wherein the ice maker evaporator 150 is connected to the ice box evaporator 96. When the valve 94 is in a first position (i.e., in through the inlet 94*a* and out through the first outlet 94*b*) the refrigerant flows along the flow path "A" through the first capillary tube 98 and enters the inlet end 162 of the ice maker evaporator 150, flows through the ice maker evaporator 150, exits the outlet end 164, enters an inlet end 96*a* of the ice box evaporator 96, flows through the ice box evaporator 96 and exits an outlet end 96*b* of the ice box evaporator 96 (represented by arrow "C"). When the valve 94 is in a second position (i.e., in through the inlet 94*a* and out through the second outlet 94*c*), the refrigerant flows along the flow path "B" through the second capillary tube 99 and enters the inlet end 96*a* of the ice box evaporator 96, flows through the ice box evaporator 96 and exits the outlet end 96*b* of the ice box evaporator (represented by arrow "C"). As such, when the valve 94 is in the second position the refrigerant bypasses the ice maker evaporator 150.

During an ice harvesting process, a full bucket mode, a defrosting of the ice box evaporator 96 or when the ice maker 50 is "OFF," the valve 94 is in the second position such that the second outlet 94*c* is fluidly connected to the ice box evaporator 96 and the refrigerant bypasses the ice maker evaporator 150, 350. During other processes/modes of operation, the valve 94 is in the first position such that the first outlet 94*b* of the valve 94 is connected to the ice maker evaporator 150, 350 and the refrigerant flows through the ice maker evaporator 150, 350 and then to the ice box evaporator 96.

Figure 14:
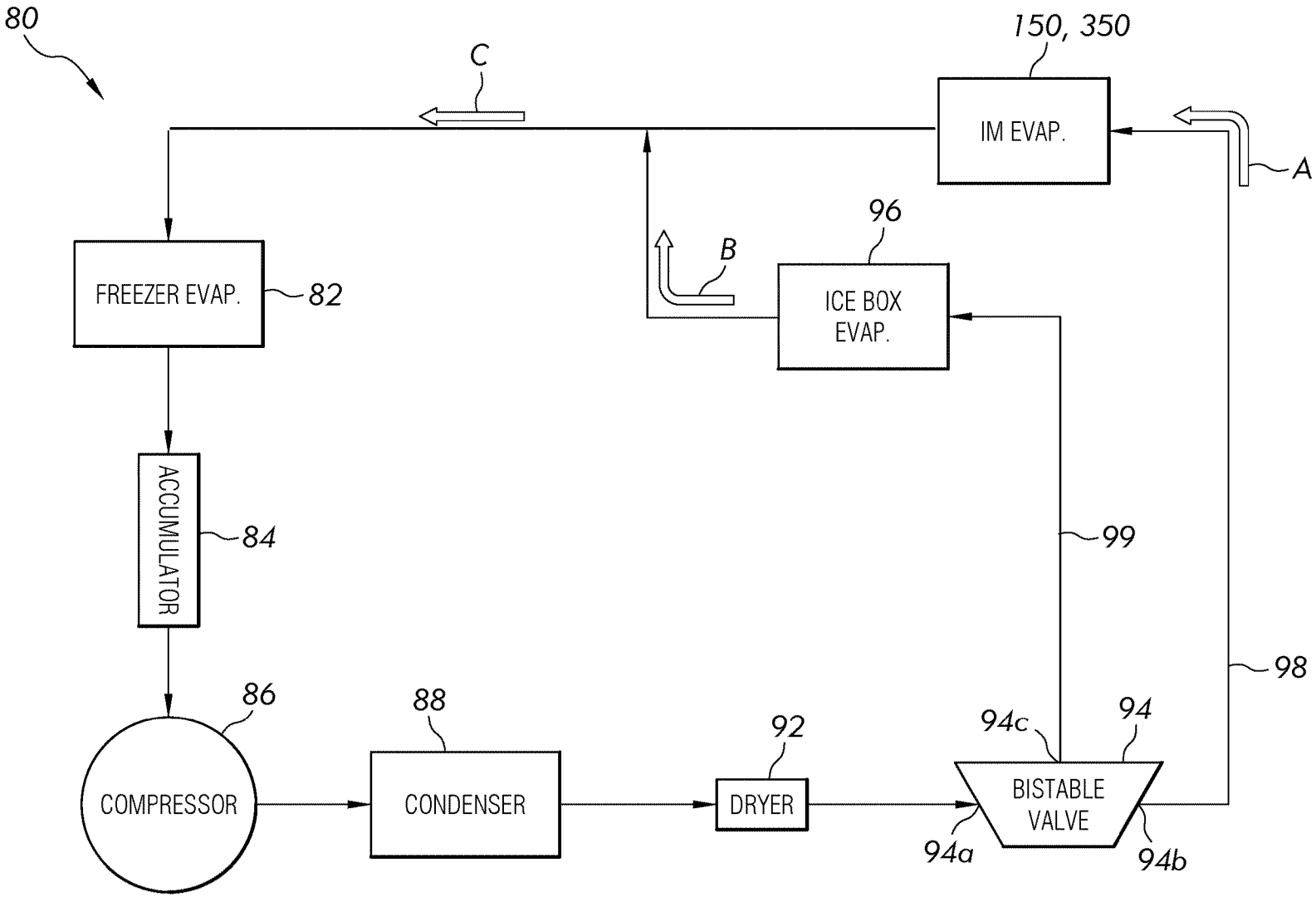
FIG. 14 is a schematic of a second embodiment cooling system for the refrigerator of FIG. 1.

FIG. 14 illustrates a second embodiment wherein the ice box evaporator 96 and the ice maker evaporator 150, 350 are disposed in parallel paths. The ice maker evaporator 150, 350 is connected to the first outlet 94*b* of the bistable valve 94 by the first capillary tube 98 and the ice box evaporator 96 is connected to the second outlet 94*c* of the bistable valve 94 by the second capillary tube 99. When the valve 94 is in a first position (i.e., in through the inlet 94*a* and out through the first outlet 94*b*) the refrigerant flows along the flow path "A" through the first capillary tube 98 and the ice maker evaporator 150. When the valve 94 is in a second position (i.e., in through the inlet 94*a* and out through the second outlet 94*c*), the refrigerant flows along the flow path "B" through the second capillary tube 99 and the ice box evaporator 96. As such, when the valve 94 is in the second position the refrigerant bypasses the ice maker evaporator 150 and when the valve 94 is in the first position the refrigerant bypasses the ice box evaporator 96. As shown in FIG. 14, the ice box evaporator 96 is disposed in a bypass line or path around the ice maker evaporator 150, 350. Alternatively, the ice maker evaporator 150, 350 is disposed in a bypass line or path around the ice box evaporator 96.

During an ice harvesting process, a full bucket mode, a defrosting of the ice box evaporator 96 or when the ice maker 50 is "OFF," the valve 94 is in the second position such that the second outlet 94*c* is fluidly connected to the ice box evaporator 96 and the refrigerant bypasses the ice maker evaporator 150, 350. During other processes/modes of operation, the valve 94 is in the first position such that the first outlet 94*b* of the valve 94 is connected to the ice maker evaporator 150, 350 and bypasses the ice box evaporator 96.

The switching of the valve 94 is designed to reduce the operational cost of the cooling system 80 for the ice maker 50. For simplicity, the housing of the air handler assembly 70 is not shown in FIG. 12. Arrows in FIG. 12 illustrate that path of the refrigerant through the ice maker evaporator 150 and the ice box evaporator 96.

It is contemplated that the valve 94 may be, such as but not limited to, a bistable valve, a stepper valve or an electronic expansion valve that is configured to control the flow of refrigerant entering the ice maker evaporator 150, 350. The bistable valve may be a binary valve, i.e., an "either/or" valve wherein 100% of the flow exits through either the first outlet 94*b* or the second outlet 94*c*. The electronic expansion valve allows the flow of refrigerant to the ice maker evaporator 150, 350 independently of the flow of the refrigerant to the ice box evaporator 96. Thus, the flow of refrigerant to the ice maker evaporator 150, 350 can be discontinued as appropriate during ice making even though the compressor 86 is operational and refrigerant is being delivered to the ice box evaporator 96. Additionally, the opening and closing of the electronic expansion valve can be controlled to regulate the temperature of at least one of the ice maker evaporator 150, 350 and the ice box evaporator 96. A duty cycle of the electronic expansion valve, in addition to or in lieu of the operation of the compressor 86, can be adjusted to change the amount of refrigerant flowing through the ice maker evaporator 150, 350 based on the demand for cooling. There is a greater demand for cooling by the ice maker evaporator 150, 350 while water is being frozen to form the ice pieces than there is when the ice pieces are not being produced. It is therefore possible to avoid changing the operation of the compressor 86 while the electronic expansion valve is operational to account for the needs of the ice maker evaporator 150, 350.

When ice is to be produced by the ice maker 50, a controller (not shown) can at least partially open the electronic expansion valve. After passing through the electronic expansion valve the refrigerant enters the ice maker evaporator 150, 350 where it expands and at least partially evaporates into a gas. The latent heat of vaporization required to accomplish the phase change is drawn from the ambient environment of the ice maker evaporator 150, 350, thereby lowering the temperature of an external surface of the ice maker evaporator 150, 350 to a temperature that is below 0° C. The temperature of the portion of the ice molds 102, 202, 302 exposed to the external surface of the ice maker evaporator 150, 350 decreases thereby causing water in the cavities 112 to freeze and form the ice pieces.

Figure 13:
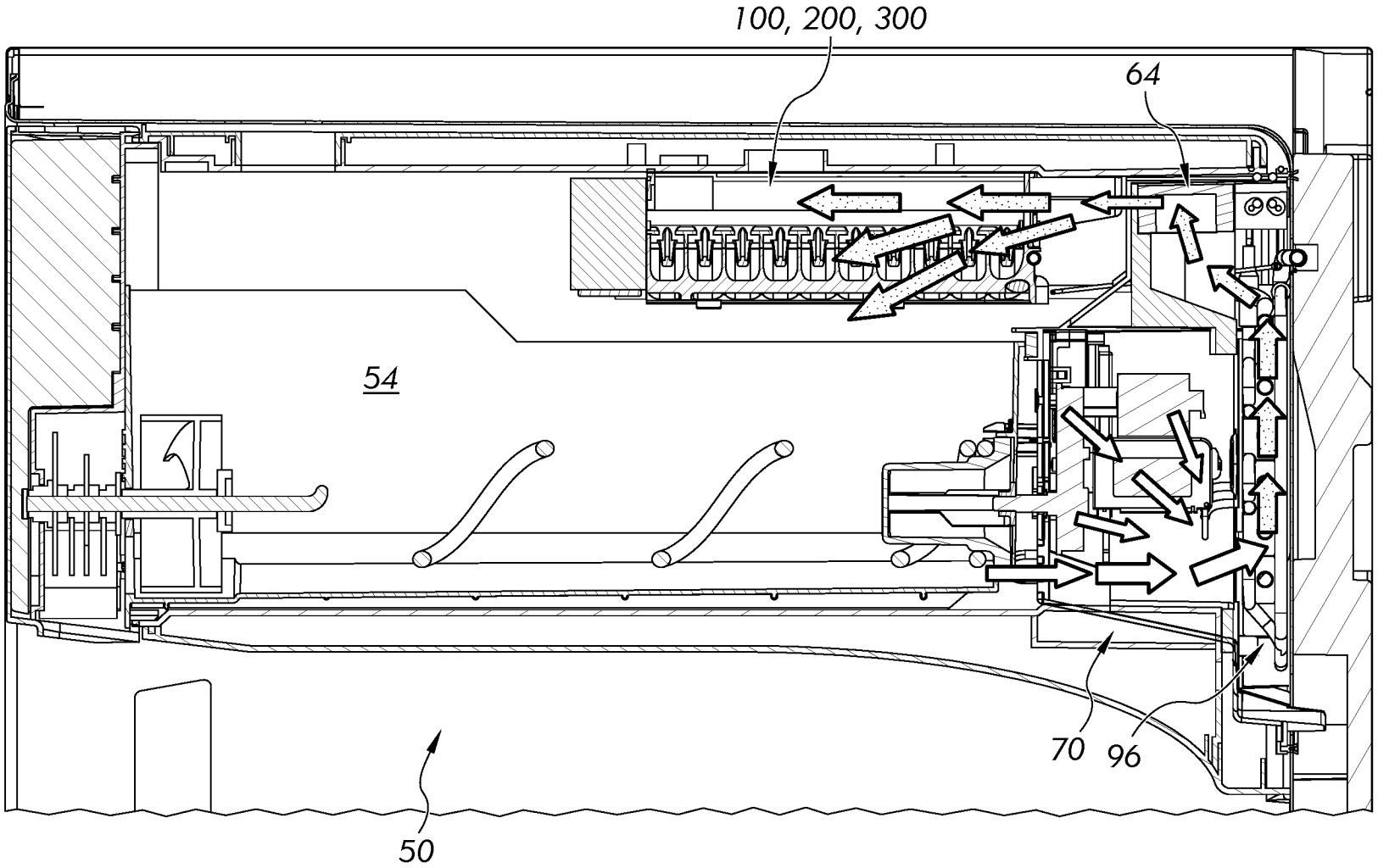
FIG. 13 is a side section view taken along line 13-13 of FIG. 3.

Referring to FIG. 13, the ice maker 50 includes a circulation fan 64. The ice box evaporator 96 is disposed proximate the circulation fan 64 such that air is drawn from the ice bin 54, over the ice box evaporator 96 and back to the ice bin 54. It is contemplated that the circulation fan 64 may be a centrifugal or squirrel-cage type fan wherein air is drawn into a center of the fan 64 and then exhausted radially away from the fan. It is also contemplated that the circulation fan 64 may be an axial fan wherein air is conveyed through the fan along a rotational axis of the fan. It is contemplated that the ice box evaporator 96 may include a heater 97 (FIG. 12) that may be energized during a defrost cycle of the ice box evaporator 96. The heater may be configured such that heat generated by the heater is sufficient to defrost both the ice box evaporator 96 and the fill cup 136 (FIG. 5) of the ice tray assembly 100.

The dedicated ice maker evaporator 150, 350 removes thermal energy from water in the ice mold 102, 202, 302 to create the ice pieces. As described previously herein, the ice maker evaporator 150, 350 may be configured to be a portion of the same refrigeration loop as the freezer evaporator 82 that provides cooling to the freezer compartment 22 of the refrigerator 20. In various examples, the ice maker evaporator 150, 350 can be provided in serial or parallel configurations with the freezer evaporator 82. In yet another example, the ice maker evaporator 150, 350 can be configured as a completely independent refrigeration system.

In addition or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a fresh food compartment for storing food items in a refrigerated environment having a target temperature above 0° C.;

a freezer compartment for storing food items in a sub-freezing environment having a target temperature below 0° C.;

a system evaporator for providing a cooling effect to at least one of the fresh food compartment and the freezer compartment;

a condenser for condensing a refrigerant;

an ice maker disposed within the fresh food compartment for freezing water into ice pieces, the ice maker comprising:

an ice mold with an upper surface comprising a plurality of cavities formed therein for the ice pieces; and an ice maker refrigerant tube for cooling the ice mold to a temperature below 0° C. via thermal conduction;

a valve comprising:

an inlet connected to the condenser;

a first outlet connected to an inlet of the ice maker refrigerant tube; and a second outlet connected to a bypass line around the ice maker refrigerant tube, wherein the inlet of the valve is connected to the first outlet of the valve when the valve is in a first position such that the refrigerant flows through the condenser, the valve, the ice maker refrigerant tube and the system evaporator, in that order, and wherein the inlet of the valve is connected to the second outlet of the valve when the valve is in a second position such that the refrigerant flows through the condenser, the valve, the bypass line and the system evaporator, in that order; and an ice box evaporator connected to an outlet of the ice maker refrigerant tube and the bypass line, wherein when the valve is in the first position the refrigerant flows only through the ice maker refrigerant tube, the ice box evaporator and the system evaporator, in that order, and when the valve is in the second position the refrigerant flows only through the ice box evaporator and the system evaporator, in that order.

2. The refrigeration appliance of claim 1, wherein the ice maker refrigerant tube abuts at least one lateral side surface of the ice mold.

3. The refrigeration appliance of claim 1, wherein the ice mold includes at least one passage extending through the ice mold adjacent a lateral side surface of the ice mold for conveying a refrigerant there through.

4. The refrigeration appliance of claim 1, wherein the system evaporator is a fresh food evaporator or a freezer evaporator.

* * * * *